United States Patent [19]

Russ, III

[11] Patent Number: 4,683,681

[45] Date of Patent: Aug. 4, 1987

[54] GRINDING WHEEL WITH BALANCING RING

[76] Inventor: Peter J. Russ, III, 12933 W. Eight Mile Rd., Detroit, Mich. 48235

[21] Appl. No.: 895,695

[22] Filed: Aug. 12, 1986

[51] Int. Cl.[4] ..... B24B 41/04; F16F 15/22

[52] U.S. Cl. ..... 51/169; 51/209 R; 73/487; 74/573 R

[58] Field of Search ..... 51/169, 209 R, 204, 51/168; 73/487; 74/573 R

[56] References Cited

U.S. PATENT DOCUMENTS

| | | | |
|---|---|---|---|
| 540,925 | 6/1895 | Roy | 51/169 |
| 817,462 | 4/1906 | Backus | 51/169 |
| 861,463 | 7/1907 | Hyde | 51/169 |
| 1,314,005 | 8/1919 | Louden | 51/169 |
| 1,352,005 | 9/1920 | Larsson | 51/169 |
| 1,913,852 | 6/1933 | O'Sullivan | 51/169 |
| 1,975,053 | 9/1934 | Simonds | 74/573 |
| 2,250,580 | 7/1941 | Gregory | 51/209 R |
| 2,518,226 | 8/1950 | Drake | 51/169 |
| 4,109,549 | 8/1978 | Vincent | 51/169 |

*Primary Examiner*—Roscoe V. Parker

*Attorney, Agent, or Firm*—Charles W. Chandler

[57] ABSTRACT

A grinding wheel having a hollow balance ring embedded in the grinding wheel material about the arbor hole. Steel shot partially fills the balance ring and automatically moves to a position to dampen any rotating imbalance in the grinding wheel both when it is new and as it wears. The balance ring can also function as a substitute for the conventional fracture or safety ring in the grinding wheel.

7 Claims, 7 Drawing Figures

GRINDING WHEEL WITH BALANCING RING

BACKGROUND OF THE INVENTION

This invention is related to a grinding wheel having a hollow balance ring embedded in the grinding wheel material with metal shot partially filling the balance ring so as to automatically balance the grinding wheel as it is being rotated.

Grinding wheels are formed of an abrasive material and usually have a degree of imbalance which may be significant as the wheel is being rotated. One approach to balancing such devices have been to mount a series of irregularly spaced weights in the mounting structure. The position of the weights are adjusted, and then the weights locked in place to balance the rotating components. Such a balancing arrangement is illustrated in U.S. Pat. No. 2,518,226, which issued to A. M. Drake, Aug. 8, 1950.

SUMMARY OF THE INVENTION

The broad purpose of the present invention is to provide improved means for balancing a grinding wheel by embedding a hollow ring in the wheel. The ring is supported such that its central axis coincides with the axis of rotation of the grinding wheel. The ring defines an interior annular channel. The channel is partially filled with steel shot which automatically moves to a position so as to dampen out any imbalance as the grinding wheel is being rotated.

The balance ring can be mounted in a variety of ways in either cylindrical grinding wheels, disc wheels or snagging wheels. It can be used either in place of or in addition to the conventional fracture retaining ring, commonly employed as a safty ring in the grinding wheel to prevent it from totally disintegrating, which sometimes occurs when the wheel is being rotated. The balance ring can be built into a groove or recess on either one or both sides of the wheel, or into an annular channel extending radially from the arbor hole. The ring can be made adjustable in diameter. The ring can be employed in grinding wheels manufactured in any type of abrasive or superabrasive material, such as diamond or cubic boron nitride (CBN), and in all bonds types, such as vitrified resin, shellac, rubber, plastic, epoxy, elastomeric, metal or the like. Any truly movable weight particles may be used, however steel shot is preferred.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
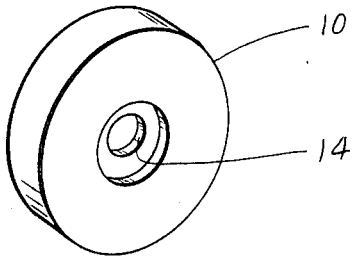
FIG. 1 is a perspective view of a grinding wheel embodying the invention.
Figure 2:
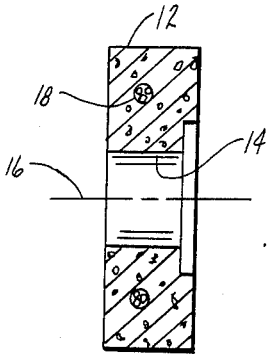
FIG. 2 is a sectional view of the grinding wheel of FIG. 1.
Figure 7:
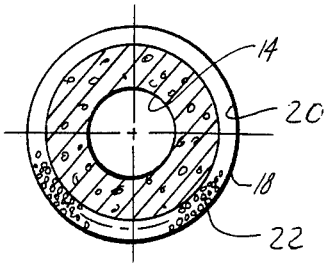
FIG. 7 is a fragmentary, sectional view of the grinding wheel of FIG. 2.

Referring to the drawing, FIGS. 1, 2 and 7 illustrate grinding wheel 10 formed of a conventional abrasive material and having a cylindrical grinding surface 12. The grinding wheel has a conventional arbor hole 14 for receiving spindle-mounting hardware, not shown, for supporting the grinding wheel for rotation about an axis 16. Hollow steel balance ring 18, illustrated in FIGS. 2 and 7, is mounted such that its central axis coincides with the axis of rotation 16 of the grinding wheel.

Referring to FIG. 7, balance ring 18 defines an endless annular channel 20. Channel 20 has about one-third of its volume filled with steel shot 22, which are freely movable in the channel.

Preferably, the relationship of the size of the internal diameter of channel 20 and the size of shot 22 is such that the shot rapidly moves to a position so as to dampen out any imbalance in the wheel as it is being rotated.

Figure 3:
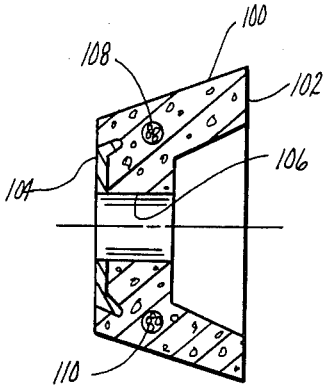
FIG. 3 is a sectional view of a cup-type snagging wheel embodying the invention.

FIG. 3 illustrated a cup-type snagging wheel 100 having a side grinding face 102 and a steel back plate 104. Arbor hole 106 may be internally threaded. A balance ring 108, partially filled with steel shot 110, is embedded in the abrasive material of the snagging wheel, similar to that illustrated in FIGS. 1 and 2.

Figure 4:
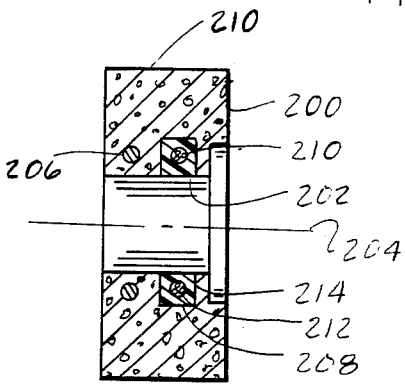
FIG. 4 is a view illustrating a balance ring mounted adjacent a safety ring.

FIG. 4 illustrates another embodiment of the invention in the form of grinding wheel 200 having a cylindrical grinding surface 210. In this embodiment of the invention, wheel 200 has an arbor hole 202 for receiving a spindle (not shown) for rotation about axis 204. Grinding wheel 200 has a steel safety ring 206 imbedded in the abrasive material and is intended to prevent the grinding wheel from totally disintegrating if a portion of it should become shattered when rotating.

In this embodiment of the invention, the grinding wheel is formed with an internal channel 208 that opens from the arbor hole. Balance ring 210, partially filled with shot 212, is then embedded in channel 208 by a bonding material 214 which includes sulfur and glue.

Figure 5:
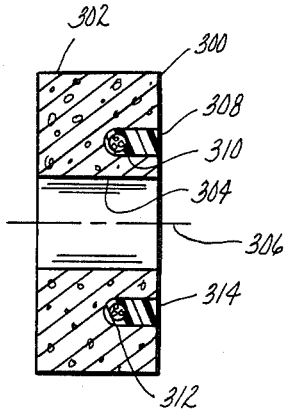
FIG. 5 is a view of a balance ring mounted in the side of a cylindrical grinding wheel.

FIG. 5 illustrates another embodiment of the invention comprising a grinding wheel 300 having a cylindrical grinding surface 302 and a central arbor hole 304. The arbor hole is adapted to support a spindle (not shown) for rotating the wheel about axis 306. In this case, the grinding wheel has an annular groove 308 formed in its side. Balance ring 310, partially filled with steel shot 312, is embedded in the groove by a bonding material 314, such as a combination of glue and sulfur. As in the other embodiments, balance ring 310 is supported with its central axis coinciding with the axis of rotation of the grinding wheel. In this embodiment of the invention, the balance ring provides a substitute for the conventional safety fracture ring sometimes used in conventional grinding wheels.

Figure 6:
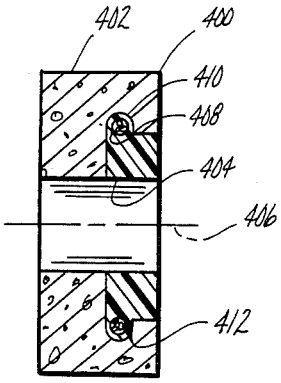
FIG. 6 is a view illustrating an adjustable ring mounted in the side of a cylindrical grinding wheel.

FIG. 6 shows still another embodiment of the invention in the form of grinding wheel 400 having a cylindrical grinding surface 402. Grinding wheel 400 is formed of an appropriate abrasive material and has an arbor hole 404. Wheel 400 is adapted to be supported for rotation about axis 406.

In this case, the grinding wheel has an annular opening 408 and an adjustable balance ring 410 partially filled with shot 412. The diameter of the balance ring is adapted to be expanded or reduced preferably by having flared ends, not shown, so that the diameter can be adjusted to suit the grinding wheel. In addition, like the other embodiments, balance ring 410 is supported such that its central axis coincides with the axis of rotation 406 of the grinding wheel.

Thus, it is to be understood that I have described an improved grinding wheel having a balance ring embedded in the grinding wheel material. The balance ring is hollow so as to form an annular channel supported such that its central axis coincides with the axis of rotation of the grinding wheel. The balance ring is partially filled with steel shot particles so that the movable mass of the shot tends to quickly dampen out any imbalance in the grinding wheel as the wheel is being rotated.

Having described my invention, I claim:

1. A combination comprising:

a grinding wheel adapted to be rotated about an axis, the grinding wheel including a mass of abrasive material;

a hollow balance ring embedded in the grinding wheel material, the balance ring being formed about a central axis coinciding with the axis of rotation of the grinding wheel, the balance ring having an endless, internal annular channel; and a plurality of steel shot, partially filling the annular channel so as to move to a position to dampen any dynamic imbalance in the grinding wheel as it is being rotated about the axis of rotation.

2. A combination in claim 1, including a fracture ring embedded in the grinding wheel abrasive material, and having a central axis disposed so as to generally coincide with the axis of rotation of the grinding wheel.

3. A combination as defined in claim 1, in which the hollow balance ring functions as a fracture ring to help prevent the grinding wheel, if fractured, from totally disintegrating as it is being rotated.

4. A combination as defined in claim 1, in which the grinding wheel has a central opening defining an arbor hole, and an annular channel opening to the arbor hole for receiving the balance wheel.

5. A combination as defined in claim 1, in which the grinding wheel has an arbor hole, and an annular channel disposed outside the arbor hole opening, and in which the balance ring is disposed in said annular opening.

6. A combination as defined in claim 1, in which the grinding wheel has a generally cylindrical grinding surface.

7. A combination as defined in claim 1, in which the grinding wheel has a grinding surface disposed generally in a plane transverse to the axis of rotation of the grinding wheel.

* * * * *